US010016339B2

(12) United States Patent
Guala

(10) Patent No.: US 10,016,339 B2
(45) Date of Patent: Jul. 10, 2018

(54) ACCESS DEVICE FOR CONTAINERS OF FLUIDIZABLE SUBSTANCES

(71) Applicant: INDUSTRIE BORLA S.p.A., Moncalieri (Turin) (IT)

(72) Inventor: Gianni Guala, Turin (IT)

(73) Assignee: INDUSTRIE BORLA S.P.A., Moncalieri (Turin) (IT)

( * ) Notice: Subject to any disclaimer, the term of this patent is extended or adjusted under 35 U.S.C. 154(b) by 0 days.

(21) Appl. No.: 15/117,026

(22) PCT Filed: Jan. 30, 2015

(86) PCT No.: PCT/IB2015/050713
§ 371 (c)(1),
(2) Date: Aug. 5, 2016

(87) PCT Pub. No.: WO2015/118432
PCT Pub. Date: Aug. 13, 2015

(65) Prior Publication Data

US 2017/0079880 A1 Mar. 23, 2017

(30) Foreign Application Priority Data

Feb. 7, 2014 (IT) ..... TO2014A0099

(51) Int. Cl.
*A61J 1/20* (2006.01)
*A61J 1/14* (2006.01)
*B65B 69/00* (2006.01)

(52) U.S. Cl.
CPC ..... *A61J 1/201* (2015.05); *A61J 1/1406* (2013.01); *A61J 1/20* (2013.01); *A61J 1/2037* (2015.05);
(Continued)

(58) Field of Classification Search
CPC ..... A61J 1/201; A61J 1/2037; A61J 1/2055; A61J 1/2072; A61J 1/2075; A61J 1/2082;
(Continued)

(56) References Cited

U.S. PATENT DOCUMENTS 7,743,799 B2 6/2010 Mosler et al.
8,523,838 B2 9/2013 Tornqvist
(Continued)

FOREIGN PATENT DOCUMENTS

WO 2013025946 A1 2/2013

OTHER PUBLICATIONS

International Search Report and Written Opinion for International Application No. PCT/IB2015/050713 filed Jan. 30, 2015, dated May 12, 2015 and completed on Apr. 24, 2015.

*Primary Examiner* — Timothy L Maust
*Assistant Examiner* — Andrew Schmid
(74) *Attorney, Agent, or Firm* — Heslin Rothenberg Farley & Mesiti P.C.; Victor A. Cardona, Esq.

(57) ABSTRACT

An access device for containers of fluidizable substances includes a body provided with a hollow spike designed to be inserted into a container of a substance to fluidize and having an axial fluid passage and an axial passage for venting of the container, an expandable chamber connected to the venting passage of the spike through a lateral passage of the body, a first check valve enabling one-way communication from the lateral passage to the expandable chamber, a second check valve enabling one-way communication from a vent opening to the venting passage of the spike. A double impermeable filtering membrane is interposed between the first check valve and the second check valve.

3 Claims, 3 Drawing Sheets

(52) U.S. Cl.
CPC ..... *A61J 1/2055* (2015.05); *A61J 1/2072* (2015.05); *A61J 1/2075* (2015.05); *A61J 1/2082* (2015.05); *A61J 1/2096* (2013.01); *B65B 69/0041* (2013.01)

(58) Field of Classification Search
CPC ..... A61J 1/1406; A61J 1/20; A61J 1/2096; B65B 69/0041
USPC ..... 141/329
See application file for complete search history.

(56) References Cited

U.S. PATENT DOCUMENTS

| | | | | |
|---|---|---|---|---|
| 8,622,985 | B2 * | 1/2014 | Ellstrom | A61J 1/2096 604/405 |
| 8,657,803 | B2 * | 2/2014 | Helmerson | A61J 1/2096 604/403 |
| 9,089,475 | B2 * | 7/2015 | Fangrow | A61J 1/22 |
| 9,132,062 | B2 * | 9/2015 | Fangrow | A61J 1/2096 |
| 2007/0106244 | A1 * | 5/2007 | Mosler | A61J 1/2096 604/411 |
| 2008/0172024 | A1 * | 7/2008 | Yow | A61J 1/2096 604/411 |
| 2010/0147402 | A1 * | 6/2010 | Tornqvist | F16K 15/147 137/513 |
| 2014/0150925 | A1 * | 6/2014 | Sjogren | A61J 1/2096 141/94 |
| 2015/0101706 | A1 * | 4/2015 | Fukuoka | A61J 1/2096 141/27 |
| 2015/0126974 | A1 * | 5/2015 | Sanders | A61J 1/2072 604/533 |

* cited by examiner

ACCESS DEVICE FOR CONTAINERS OF FLUIDIZABLE SUBSTANCES

CROSS REFERENCE TO RELATED APPLICATIONS

This application is a national stage of PCT International Application No. PCT/IB2015/050713 filed on Jan. 30, 2015, and published in English on Aug. 13, 2015 as WO 2015/118432 A1, which claims priority from Italian Patent Application No. TO2014A000099 filed on Feb. 7, 2014, the entire disclosures of which are incorporated herein by reference.

FIELD OF THE INVENTION

The present invention relates to access devices for containers of substances to fluidize, for example, vials containing powdered medicines such as antibiotics and toxic drugs of the type administered during chemotherapy treatments and the like.

STATE OF THE PRIOR ART

In the U.S. Pat. No. 7,743,799, of which the Applicant is the proprietor, an access device is known, comprising a body provided with a hollow spike designed to be inserted into a container of fluidizable substances and having an axial fluid passage and an axial passage for venting of the container. An expandable chamber is connected to the venting passage of the spike through a lateral passage of the body, and the device also includes a first check valve, which enables one-way communication from the lateral passage to the expandable chamber, and a second check valve, which enables one-way communication from a vent opening to the venting passage of the spike.

Such devices are used, for example, to add a diluent liquid to a dry medicinal substance contained in the vial to allow the subsequent transfer of the medicinal substance, thus fluidized, from the vial to a patient, for example by means of an infusion bag.

During introduction of the liquid into the vial through the fluid passage of the spike, normally inserted in a sealable manner through a pierceable resilient cap of the vial, the gaseous phases produced by the medicinal substance following its dilution are conveyed under pressure, through the lateral passage of the body and the first one-way check valve, into the expandable chamber and captured inside. In this way, these gaseous phases do not contaminate the ambient air, thus preventing inhalation and coming into contact with the operator handling the access device, with the associated risks to his/her health.

When the medicinal substance, diluted as such, is extracted from the vial, by suction through the fluid passage of the spike, the second one-way check valve enables rebalancing of the pressure within the vial.

In a first embodiment of the access device according to the document U.S. Pat. No. 7,743,799, a respective filter is arranged upstream of each of the two check valves. In the other embodiments exemplified in the document U.S. Pat. No. 7,743,799, a single filtering membrane is instead provided, formed by a liquid-impermeable material. This impermeable filtering membrane is arranged coaxially to the spike and is formed with a central hole crossed in a sealable manner by the spike itself. The first and second check valves are located on the same side with respect to this impermeable filtering membrane, which carries out a dual function: it filters the air introduced into the vial through the second check valve, and constitutes a barrier, which prevents the entry of liquid, or rather, of the diluted medicinal substance, within the expandable chamber through the first check valve.

An analogous solution is described in the document U.S. Pat. No. 8,523,838, in which both one-way check valves are arranged in the lateral passage of the body, also in this case on the same side with respect to an impermeable filtering membrane, which is directly applied at the inlet of the expandable chamber. Venting of the vial during the extracting step of the diluted medicinal substance therefore uses the contaminated atmosphere contained within the expandable chamber, which may lead to problems. Furthermore, although this document includes specific opening pressures of the two one-way valves, particles of aerosolized medication, which have possibly penetrated into the expandable chamber can still clog the filtering membrane, and block or at least unacceptably reduce the venting flow of the vial, with consequent difficulties of extracting the medicinal substance from the vial.

In the case of the document WO-2013/025946, two check valves are provided as well, and a filter is positioned between the two check valves and the venting passage of the spike.

SUMMARY OF THE INVENTION

The present invention aims to eliminate the abovementioned drawbacks and to perfect the access device described and illustrated in the document cited above, U.S. Pat. No. 7,743,799, also in relation to improved safety against the risk of environmental dispersion of medicinal substances extracted from the vial during use of the device.

According to the invention, this object is primarily achieved by means of an access device as defined in the pre-characterizing part of claim 1, characterized in that said impermeable filtering membrane means are interposed between said first and second check valves.

Thanks to this solution idea, the impermeable filtering membrane means not only carry out the functions of filtering the venting air of the vial and obstructing the inlet within the expandable chamber of the diluted medicinal substance, but are also able to provide a more effective barrier to escaping aerosolized particles of the medicinal substance, which may have possibly entered into the expandable chamber, in the case of malfunction or ineffective closing of the first check valve and possibly also the second check valve. Indeed, in such an eventuality, the impermeable filtering membrane means advantageously enable blocking of the backflow of aerosolized particles from the expandable chamber, both downstream of the first check valve, and upstream of the second check valve, thus securely isolating these particles within the expandable chamber.

According to a preferred embodiment of the invention, two impermeable filtering membranes are provided, parallel and adjacent to each other, in order to delimit an intermediate chamber in communication with said venting passage of the hollow spike.

The expandable chamber comprises, in a known manner, a containment housing, within which the peripheral edge of a flexible membrane is fixed: according to a further advantageous feature of the invention, this flexible membrane is over-molded within the containment housing. This allows simplification of the manufacturing method of the access device, compared to that described in the aforementioned document U.S. Pat. No. 7,743,799, in which the flexible membrane is produced separately and then joined by gluing or welding to the containment housing.

BRIEF DESCRIPTION OF THE DRAWINGS

The invention will now be described in detail with reference to the attached drawings, provided purely by way of non-limiting example, in which.

DETAILED DESCRIPTION OF THE INVENTION

Figure 1:
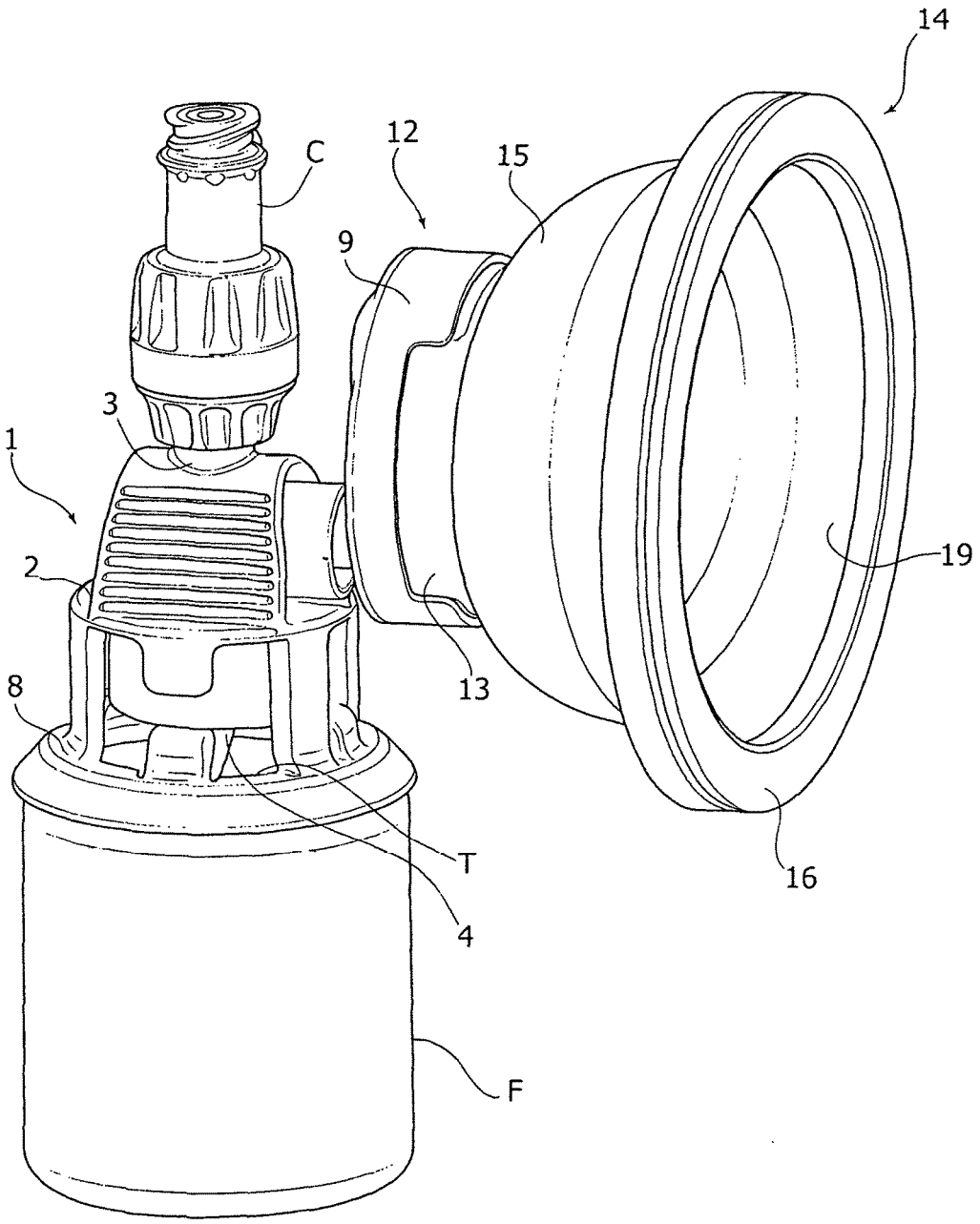
FIG. 1 is a schematic perspective view of an access device according to an embodiment of the invention, represented in a first operating condition.

Referring to the drawings, the access device for containers of medicinal substances according to the invention comprises a body of molded plastic material, generically indicated by 1, comprising a flange 2 on top of which protrudes a tubular connector 3, for example of the luer or luer lock type, and below which extends a hollow spike 4 coaxial to the tubular connector 3.

Figure 3:
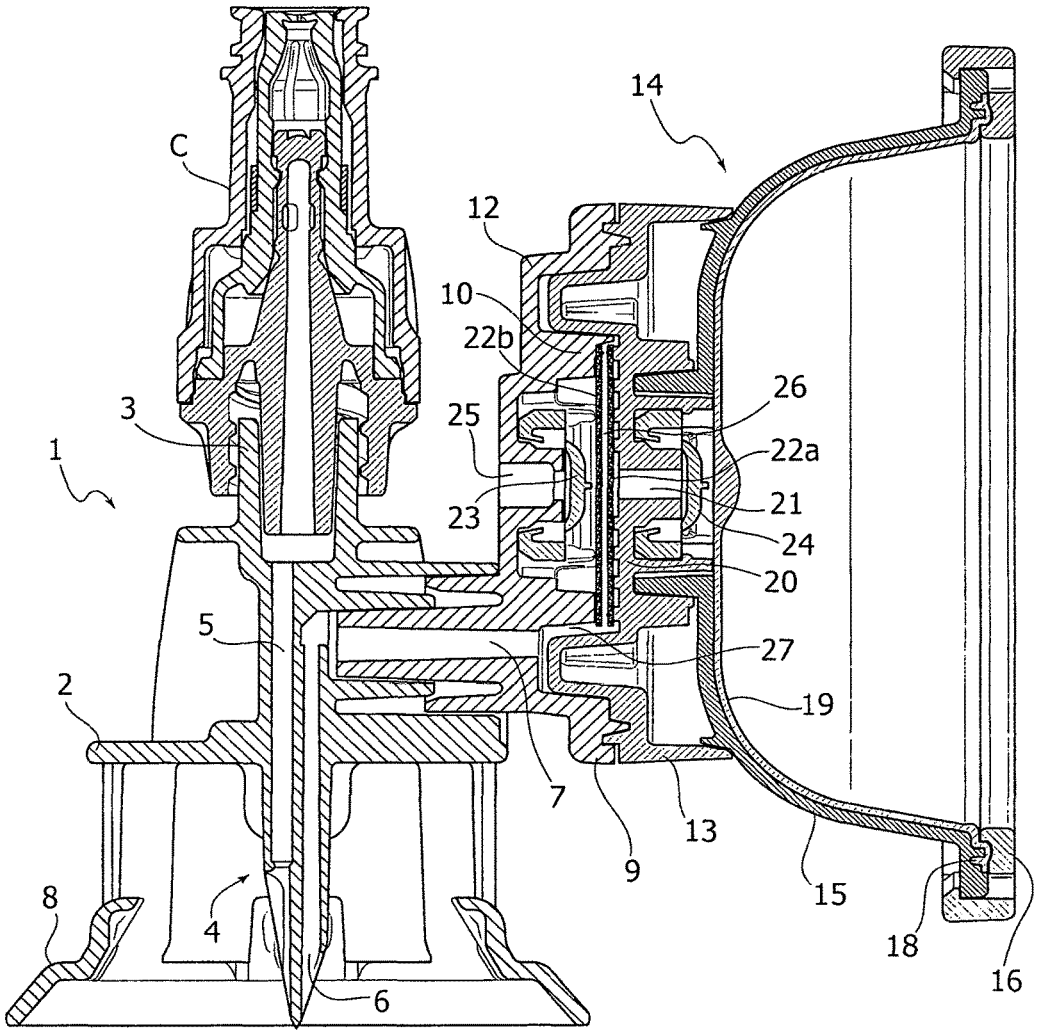
FIG. 3 is a vertical cross-sectional partial view of FIG. 1.

As is visible in FIG. 3, the hollow spike 4 has two side-by-side axial passages: a fluid passage 5, communicating at the top with the tubular connector 3, and a venting passage 6 in communication with a lateral passage 7.

Figure 2:
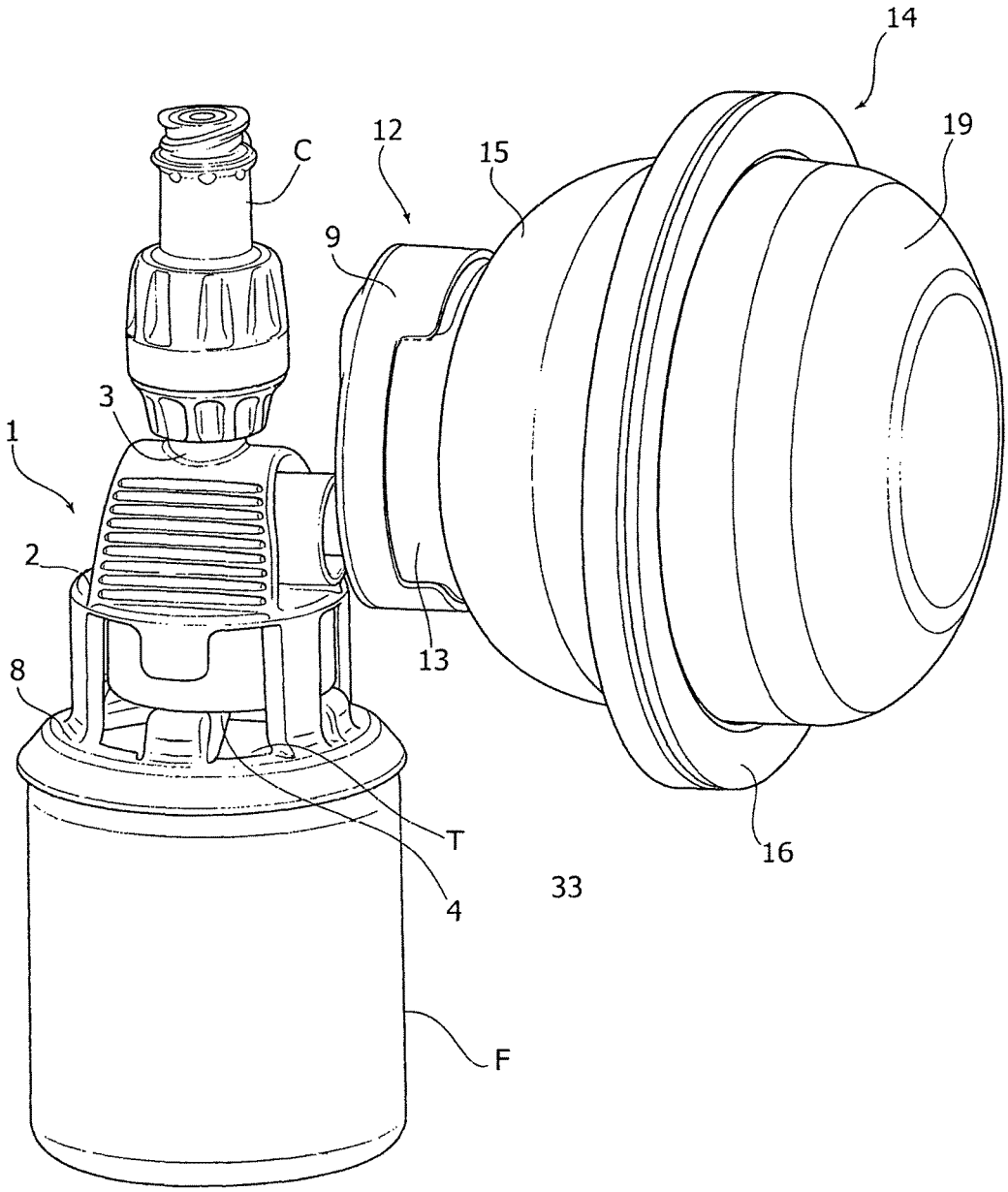
FIG. 2 is an analogous view to FIG. 1 showing the device in a second operating condition.

Below the flange 2 extends an annular skirt 8 with elastically deformable sectors, configured for engaging the complementary-shaped neck of a vial F, for example containing a dry powder, for example a medicine, intended to be fluidized and administered in the manner explained below. The vial F is sealed in a conventional manner by means of a cap T of elastomeric material, pierceable by the spike 4, when the annular skirt 8 is fitted on the neck of the vial F, as shown in FIGS. 1 and 2.

The tubular connector 3 is, in turn, configured to couple with a connector C, for example, of the valve-type, produced and marketed by the Applicant under the designation "B-Site".

The lateral passage 7 can be integrally formed with the body 1 or, as in the case of the example illustrated, it can be part of a separate intermediate element, indicated by 12, fixed laterally to the body 1. The intermediate element 12 is formed with an outer radial flange 9 and internally with an annular wall 10.

The flange 9 is fixed to a complementary flange 13 of an expandable chamber indicated as a whole by 14 and comprising a cup-shaped half-shell 15, the peripheral edge of which is fixed, at the side opposite the flange 13, to a containment ring 16 of the peripheral edge 18 of a flexible membrane 19 co-molded with the half-shell 15 and delimiting, with this, the volume of the expandable chamber 14. FIGS. 1 and 3 show the condition of minimum volume, in which the flexible membrane 19 is retracted within the half-shell 15, while FIG. 2 shows the condition of maximum volume with the membrane 19 extended outside the half-shell 15. It should be noted that the expandable chamber 14 with the relative flange 13 is applicable to bodies 1 of different forms.

The flange 13, which protrudes axially from the half-shell 15 towards the intermediate element 12, is formed internally by a labyrinth wall 20, having a central through-hole 21 for communicating with the inside of the expandable chamber 14. To this wall 20, a first filtering membrane **22*a* is fixed, formed of a disc of liquid-impermeable material, having a face coated with a thermoplastic material welded to the wall 20**.

A second filtering membrane **22*b*, similarly formed of a disc of liquid-impermeable material, has a face coated with a thermoplastic material welded to the annular wall 10**.

The two membranes **22*a* and 22*b* are parallel and slightly spaced-apart from each other so as to delimit an intermediate chamber 26, which communicates with the venting passage 6 of the spike 4 through a restricted passage 27 and the lateral passage 7 of the intermediate element 12**.

Numerals 23 and 24 indicate, respectively, two one-way check valves, one being operatively associated with a vent opening 25, centrally formed in the intermediate element 12, and the other associated with the through-hole 21 of the wall 20.

The check valve 24, which will be hereinafter indicated as the first check valve, enables one-way communication from the axial venting passage 6 of the spike 4 to the expandable chamber 14 through the lateral passage 7, the restricted passage 27, the chamber 26, the filtering membrane **22*a* and the hole 21**.

The check valve 23, which will be hereinafter indicated as the second check valve, enables one-way communication between the vent opening 25 and the venting passage 6 of the spike 4, through the second filtering membrane **22*b*, the chamber 26, the restricted passage 27 and the lateral passage 7**.

With the unique arrangement described above, the double impermeable filtering membrane **22*a*, 22*b* is therefore interposed between the check valves 23 and 24**, allowing the guarantee of improved operational safety of the access device according to the invention, whose operation is as follows.

Initially, the vial F containing the dry substance (for example, a medicinal powder or granules) is coupled to the body 2 by engaging the flange 8 so as to pierce the cap T by the spike 4. Then, as a result of the coupling with the tubular connector C, a liquid is introduced within the vial F to achieve the dilution and fluidization of the medicinal substance. The liquid is introduced, for example, by means of a syringe coupled to the tubular connector C and penetrates inside the vial F through the fluid passage 5 of the spike 4. The gaseous phases produced by the medicinal substance during the dilution thereof are driven into the venting passage 6 of the spike 4 and pass through the lateral passage 7, the restricted passage 27, the chamber 26, the filtering membrane **22*a* and the hole 21. The first check valve 24 opens, therefore allowing these gaseous phases to enter within the expandable chamber 14. At the end of this step, any aerosolized droplets of the medicinal substance which have crossed the filtering membrane 22*a*, and also possibly the filtering membrane 22*b*, are retained due to the closing of the check valve 23**.

The access device is then turned upside down to extract the fluidized medicinal substance from the vial F, by means of suction through the fluid passage 5 of the spike 4. If at this step, by error, instead of aspirating, the operator pushes air under pressure into the vial F, the liquid that is pushed towards the expandable chamber 14 through the venting passage 6 of the spike 4 would meet with the barrier operated by the two filtering membranes **22*a*, 22*b*, without being able to reach the expandable chamber 14**, let alone the external environment.

When the liquid is correctly aspirated, compensating air is introduced into the vial F through the vent opening 25 and the open check valve 23. During this step, the air coming from the vent opening 25 is filtered through the membrane 22*a*, while the valve 24 is kept closed by the pressure within the expandable chamber 14. The air thus filtered then reaches, through the chamber 26, the restricted passage 27, the lateral passage 7 and the venting passage 6 of the spike 4, the inside of the vial F. It is therefore evident that placing the filtering membrane 22*a* between the valves 23 and 24 allows the obtainment of optimum filtration of the compensating air introduced into the vial F.

In addition, the unique arrangement of the impermeable filtering membranes 22*a*, 22*b* according to the invention also allows further improvement of the operational safety of the device regarding the effects of the risk of environmental contamination by the fluidized medicinal substance extracted from the vial F, in the case of malfunction of the check valve 24 and possibly also of the check valve 23. In fact, in this case, the aerosolized particles of the medicinal substance, possibly captured within the expandable chamber 14, would still be blocked and retained by the filtering membranes 22*a*, 22*b*, without being able to reach the vent opening 25.

A further advantage lies in improved operational safety of the device in the case of improper use, resulting in overpressure being generated within the vial F. In fact, in the case in which the liquid is forced, by error, into the vial F while holding the device upside down, or rather with the spike 4 facing upwards, this liquid would reach the chamber 26, through the passage 6 and the restricted passage 27, but in this case would be blocked by the filtering membrane 22*b* without being able to reach the vent opening 25.

Of course, the details of construction and the forms of embodiment may be varied widely with respect to those described and illustrated, without departing from the scope of the present invention as defined by the following claims.

The invention claimed is:

1. Access device for containers of fluidizable substances comprising:

a body provided with a hollow spike designed to be inserted into a container of a substance to fluidize and having an axial fluid passage and an axial passage for venting of the container, an expandable chamber connected to said axial venting passage of the spike through a lateral passage of the body, a first check valve enabling one-way communication from said lateral passage to said expandable chamber, a second check valve enabling one-way communication from a vent opening to the axial venting passage of the spike, and two impermeable filtering membranes which prevent the inlet of liquids into said expandable chamber, and the loss of liquids from said vent opening, said two impermeable filtering membranes being parallel and spaced apart from each other and facing each other so as to delimit therebetween an intermediate chamber, said intermediate chamber comprising an open end bounded by said two impermeable filtering membranes, said open end in communication with said venting passage of the spike, said first check valve and said second check valve located outside said intermediate chamber.

2. Access device according to claim 1, wherein said expandable chamber comprises a half-shell housing and a flexible membrane fixed to said housing, wherein said flexible membrane is co-molded to said housing.

3. Access device according to claim 1, wherein said expandable chamber comprises a half-shell housing and a flexible membrane fixed to said housing, wherein said flexible membrane is co-molded to said housing.

* * * * *